United States Patent [19]

Tobias et al.

[11] Patent Number: 4,985,943

[45] Date of Patent: Jan. 22, 1991

[54] TWO-STAGE ADJUSTABLE HYDROTHERAPEUTIC JET AND METHOD

[75] Inventors: Samuel Tobias, Edison; Robert M. Messinger, Cranford, both of N.J.

[73] Assignee: Hayward Industries, Inc., Elizabeth, N.J.

[21] Appl. No.: 404,684

[22] Filed: Sep. 8, 1989

[51] Int. Cl.[5] ..... A61H 33/00

[52] U.S. Cl. ..... 4/542; 4/492; 4/541; 4/544; 417/428.5; 128/66

[58] Field of Search ..... 4/492, 541, 542, 544, 4/545; 239/428, 428.5; 128/66; 417/151, 174

[56] References Cited

U.S. PATENT DOCUMENTS

| | | | |
|---|---|---|---|
| 2,642,813 | 6/1953 | Woodruff et al. | 417/185 |
| 3,273,560 | 9/1966 | Jacuzzi | 4/559 |
| 3,287,741 | 11/1966 | Nash | 4/544 |
| 3,297,025 | 1/1967 | Jacuzzi | 128/66 |
| 3,336,921 | 8/1967 | Lloyd | 128/66 |
| 3,345,982 | 10/1967 | Guiler | 128/66 |
| 3,391,870 | 7/1968 | Nash | 4/559 |
| 3,396,722 | 8/1968 | Lindberg, Jr. | 128/66 |
| 3,471,091 | 10/1969 | Baker | 239/416 |
| 3,504,702 | 4/1970 | Collins et al. | 137/369 |
| 3,540,438 | 11/1970 | Jacuzzi | 128/66 |
| 3,541,616 | 11/1970 | Stricker | 128/66 |
| 3,605,131 | 9/1971 | Brazel et al. | 4/491 |
| 3,614,952 | 10/1971 | Agnellino | 128/66 |
| 3,745,994 | 7/1973 | Kane | 128/66 |
| 3,890,655 | 6/1975 | Mathis | 128/66 |
| 3,890,656 | 6/1975 | Mathis | 128/66 |
| 3,905,358 | 9/1975 | Jacuzzi | 128/66 |
| 3,946,449 | 3/1976 | Mathis | 128/66 |
| 3,977,027 | 8/1976 | Speck | 128/66 |
| 4,082,091 | 4/1978 | Raab | 128/66 |
| 4,168,705 | 9/1979 | Raab | 128/66 |
| 4,220,145 | 9/1980 | Stamp | 128/66 |
| 4,221,336 | 9/1980 | Diamond | 239/428.5 |
| 4,240,166 | 12/1980 | Altman | 4/542 |
| 4,261,347 | 4/1981 | Spencer, III | 128/66 |
| 4,262,371 | 4/1981 | Berry et al. | 4/492 |
| 4,264,039 | 4/1981 | Moreland | 239/428.5 |
| 4,335,854 | 6/1982 | Reynoso | 239/428.5 |
| 4,339,833 | 7/1982 | Mandell | 4/542 |
| 4,349,923 | 9/1982 | Chalberg | 4/542 |
| 4,358,862 | 11/1982 | Altman et al. | 4/542 |
| 4,379,097 | 4/1983 | Leggett | 4/542 |
| 4,402,094 | 9/1983 | Sanders | 4/504 |
| 4,416,030 | 11/1983 | Reynoso | 239/428.5 |
| 4,420,846 | 12/1983 | Bonner | 4/541 |
| 4,422,191 | 12/1983 | Jaworski | 4/496 |
| 4,442,045 | 4/1984 | Sciolla | 239/428.5 |
| 4,460,519 | 7/1984 | Leggett | 4/542 |
| 4,466,141 | 8/1984 | Starkey | 4/492 |
| 4,501,659 | 2/1985 | Henk | 210/169 |
| 4,502,168 | 3/1985 | Jaworski | 4/496 |
| 4,508,665 | 4/1985 | Spinnett | 4/542 |
| 4,520,514 | 6/1985 | Johnson | 4/492 |
| 4,523,340 | 7/1985 | Watkins | 4/542 |
| 4,525,881 | 7/1985 | Higginbotham | 4/496 |
| 4,537,358 | 8/1985 | Anderson | 239/428.5 |
| 4,541,780 | 9/1985 | Moreland | 4/542 |
| 4,542,853 | 9/1985 | Diamond | 239/428.5 |
| 4,542,854 | 9/1985 | Mathis | 4/542 |
| 4,593,420 | 6/1986 | Tobias | 4/492 |
| 4,671,463 | 6/1987 | Moreland et al. | 4/542 |
| 4,679,258 | 7/1987 | Henkin | 4/542 |
| 4,689,839 | 9/1987 | Henkin et al. | 4/542 |
| 4,715,071 | 12/1987 | Henkin et al. | 4/542 |
| 4,731,887 | 3/1988 | Henkin et al. | 4/542 |
| 4,742,965 | 5/1988 | Messinger | 239/417.3 |
| 4,813,086 | 3/1989 | Henkin et al. | 4/542 |
| 4,853,987 | 8/1989 | Jaworski | 4/542 |

*Primary Examiner*—Henry J. Recla
*Assistant Examiner*—Edward C. Donovan
*Attorney, Agent, or Firm*—Ralph W. Selitto, Jr.

[57] ABSTRACT

A hydrotherapeutic jet for a hydrotherapeutic receptacle employs three nozzels and two separate mixing chambers. A primary stream of water flows through the first nozzel to create a low pressure condition which sucks air into the first mixing chamber, causing the primary stream to be mixed with the air. The primary stream is discharged through the second nozzle into the second mixing chamber, thereby creating another low pressure condition which sucks a secondary stream of water from the hydrotherapeutic receptacle into the second mixing chamber and hence causes the aerated primary stream to be entrained with the secondary stream. The air/water mixture is then discharged from the second mixing chamber into the hydrotherapeutic receptacle by te third nozzle.

39 Claims, 7 Drawing Sheets

TWO-STAGE ADJUSTABLE HYDROTHERAPEUTIC JET AND METHOD

FIELD OF THE INVENTION

The present invention relates to jet fittings for hydrotherapeutic, receptacles, such as a bathtubs, spas and therapy tanks, and, more particularly, to such fittings which are adapted to enhance the flow of water discharged therefrom.

BACKGROUND OF THE INVENTION

Whirlpool-type baths have long been employed to treat discomfort resulting from strained muscles, joint ailments and the like. More recently, such baths have been used increasingly as a means of relaxing from the daily stresses of modern life. A therapeutic effect is derived from bubbling water and swirling jet streams which create an invigorating motion to massage the user's body.

To create the desired whirlpool motion and hydromassage effect, jet fittings are typically employed to inject water at a high velocity into a receptacle, such as a bathtub, spa or therapy tank. Usually, the jet fittings are adapted to aspirate air so that the water discharged into the receptacle is aerated to achieve the desired bubbling effect (see, for instance, U.S. Pat. Nos. 4,593,420 and 4,742,965).

To enhance the whirlpool motion, some jet fittings aspirate water from the receptacle, thereby increasing the discharge rate of the fitting and hence the circulation of the water contained in the receptacle. Henkin et al. U.S. Pat. No. 4,689,839 discloses such a jet fitting which (i) draws spa or tub water into a mixing tube for entrainment with a primary stream of water, (ii) aerates the combined streams in a second mixing tube, and (iii) discharges the air/water mixture into a tub through a discharge nozzle. Because the mixing tube is mounted externally of the tub and remote from the fitting, the entrainment and aeration processes occur outside of both the fitting and the tub, thereby requiring extra plumbing to convey water to and from the mixing tube. Another disadvantage involves the location of the entrance to the mixing tube, which entrance is at a height well above the discharge nozzle, but below the level of water in the tub. Therefore, water entrainment will not occur if the level of the tub water falls below the level of the entrance to the mixing tube.

Another type of hydrotherapy jet assembly, suitable for mounting in a wall of a spa, bathtub or the like, is disclosed in Henkin et al. U.S. Pat. No. 4,731,887. The jet assembly of the Henkin et al. '887 patent includes a mixing chamber which is supplied with water under pressure by a water jet nozzle. A passageway extends internally through the assembly between the mixing chamber and the spa or tub so that water can be drawn from the spa or tub for entrainment by the water jet. Thus, the stream discharged from &:he jet assembly into the spa or tub includes the following components: (i) water supplied under pressure into the mixing chamber by the water jet nozzle; and (ii) water drawn or aspirated from the spa or tub for entrainment by the water jet.

The jet assembly disclosed in the Henkin et al. '887 patent can be adapted to draw or aspirate air, as well as spa or tub water, into the mixing chamber. However, in such an adaptation, it is difficult to strike a suitable balance between the amount of aspirated spa or tub water, on the one hand, and the amount of aspirated air, on the other hand, due to the fact that an increase in the quantity of aspirated water results in a decrease in the quantity of aspirated air and vice versa. Thus, in order to ensure that the jet nozzle can create a vacuum which, in turn, creates enough suction to entrain both air and water, the jet assembly of the Henkin et al. '887 patent is very limited with respect to the flow and pressure conditions under which it will perform satisfactorily, if at all. A delicate and impractical balance therefore exists between the size of the passageway for the entrained spa or tub water and the flow of aspirated air, both of which are a function of the size of the jet nozzle. Accordingly, if built on a commercial scale for use with a standard size pump typically employed in the hydrotherapy industry, the jet assembly disclosed in he Henkin et al. '887 patent would not work properly, if at all. In fact, the passageway for the entrained spa or tub water must be almost completely closed; or, otherwise, air could not be aspirated.

Still another type of jet fitting, also suitable for mounting in a wall of a spa, bathtub or the like, is disclosed in pending U.S. patent applications Ser. No. 322,653 filed Mar. 13, 1989, and Ser. No. 329,653, filed Mar. 28, 1989, both of which are owned by the assignee of the present application. The jet fittings disclosed in these copending applications employ two nozzles which coact to form a "jet pump" effect. The jet pump creates a low pressure condition which effectively sucks a secondary stream of spa or tub water from the spa or tub into a mixing chamber for entrainment with a primary stream of water. An air supply tube extends into one of the nozzles such that the combined water streams flow around the air supply tube and thereby create a low pressure condition which sucks air into the mixing chamber for entrainment with the combined water streams. The air/water mixture is discharged into the receptacle. Although this jet fitting can function with a standard size pump, the air supply tube partially blocks the flow of the air/water mixture as it is discharged into the receptacle, thereby reducing the efficiency of the fitting.

A problem common to all of the known jet fittings adapted to aspirate air and water is that the air sucked into the mixing chamber can not be regulated independently of the water. Air cools off the water with which it is entrained. The air/water mixture, in turn, cools off the spa or tub water as it is discharged into the receptacle. For certain applications where the temperature of the water must be hot, the inability to regulate the aspirated air makes the aeration process undesirable.

SUMMARY OF THE INVENTION

In accordance with the present invention, a hydrotherapeutic jet adapted to be mounted to a wall of a hydrotherapeutic receptacle includes a first mixing (aeration) chamber located centrally within the jet and a second mixing (entrainment) chamber located within the jet between the first mixing chamber and the wall of the hydrotherapeutic receptacle. Air and water inlets provide supplies of air and a primary stream of water, respectively, to the first mixing chamber. A first nozzle increases the velocity of the primary stream of water flowing into the first mixing chamber, thereby creating a first low pressure condition within the first mixing chamber. The first low pressure condition is sufficient to suck air into the first mixing chamber through the air inlet, whereby the air is mixed with the primary stream of water. Thus, the first mixing chamber also functions as a suction chamber. The aerated primary stream is discharged by a second nozzle from the first mixing chamber into the second mixing chamber, thereby creating a second low pressure condition within the second mixing chamber. The second low pressure condition is sufficient to suck a secondary stream of water from the receptacle through a bulkhead fitting covering the second mixing chamber, and into the second mixing chamber. Thus, the second mixing chamber also functions as a suction chamber. As a result, the aerated primary stream is entrained with the secondary stream. A discharge nozzle discharges the entrained air/water mixture from the second mixing chamber into the hydrotherapeutic receptacle.

The simultaneous and efficient aeration of the water and its commingling with additional water are made possible due to the fact that the overall process is separated into two consecutive stages carried out in two separate mixing chambers. More particularly, the primary stream of water is aerated in the first mixing chamber during a first stage, whereas this aerated stream is used to entrain additional water in the second mixing chamber during a second stage. As a result, increased and aerated flow rates improve whirlpool motion and hydromassage effect, as well as the overall circulation of the water contained in the hydrotherapeutic receptacle. Moreover, because the first and second mixing chambers are separate and distinct from each other, the new and improved hydrotherapeutic jet allows the full flow of entrained water simultaneously with the full flow of aspirated air a result not obtainable by prior art devices which employ a single mixing chamber and which therefore have a very limited capability to entrain water and aspirate air simultaneously.

BRIEF DESCRIPTION OF THE DRAWINGS

For a better understanding of the present invention, reference is made to the following description of an exemplary embodiment considered in conjunction with the accompanying drawings, in which.

DESCRIPTION OF THE EXEMPLARY EMBODIMENT

Figure 1:
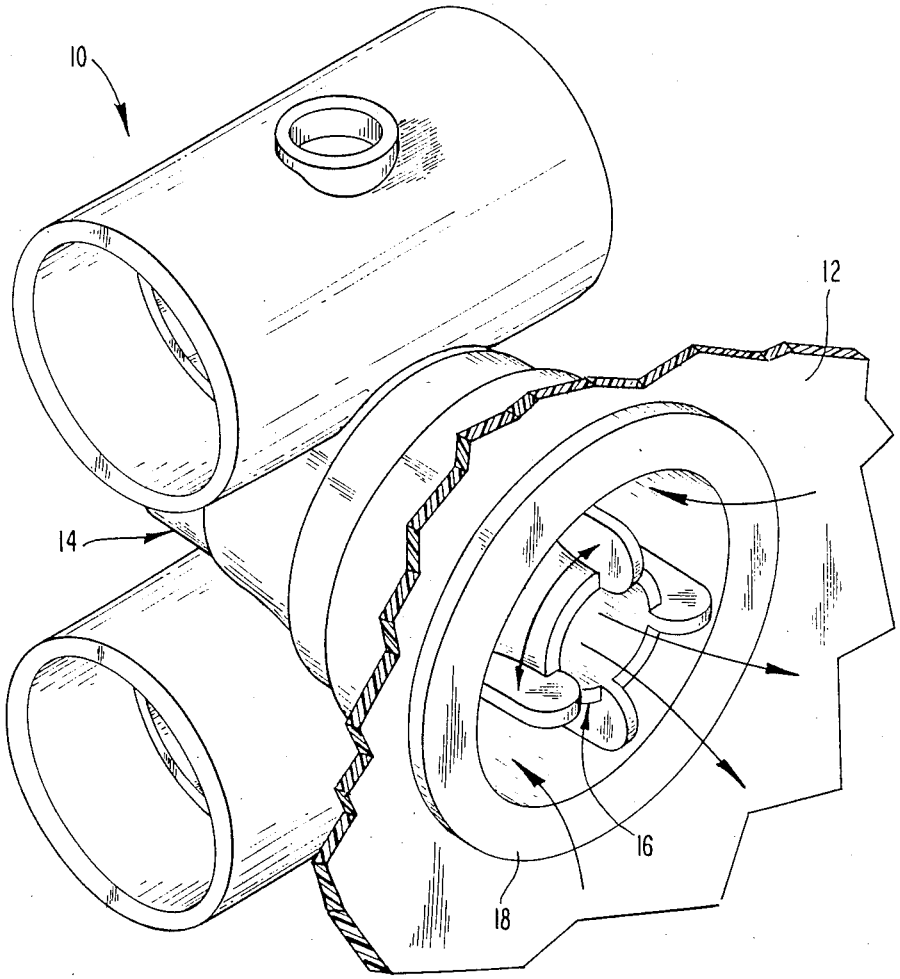
FIG. 1 is a front perspective view of a hydrotherapeutic jet constructed in accordance with the present invention and assembled in the wall of a hydrotherapeutic receptacle.

Referring to FIG. 1, a hydrotherapeutic jet 10 is attached to a sidewall 12 of a hydrotherapeutic receptacle, such as a bathtub, spa or therapy tank. The hydrotherapeutic jet 10 includes the following main components: a body 14, a tri-nozzle assembly 16 and a bulkhead fitting 18, all of which are preferably made out of a suitable polymeric material.

Figure 2:
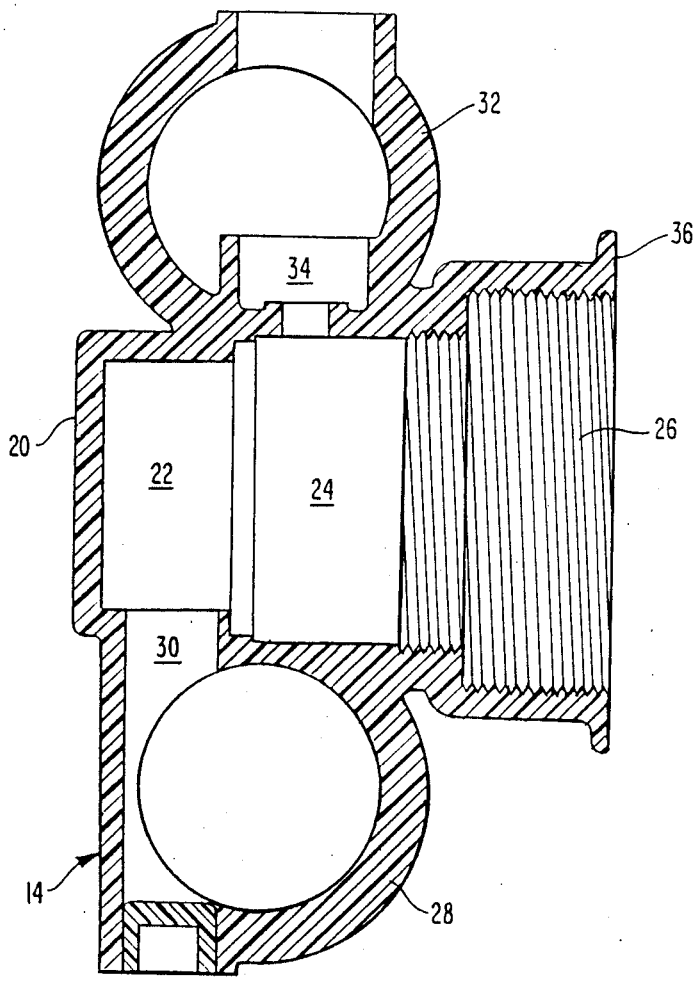
FIG. 2 is a vertical cross-sectional view of a body or housing portion of the hydrotherapeutic jet illustrated in FIG. 1.
Figure 3:
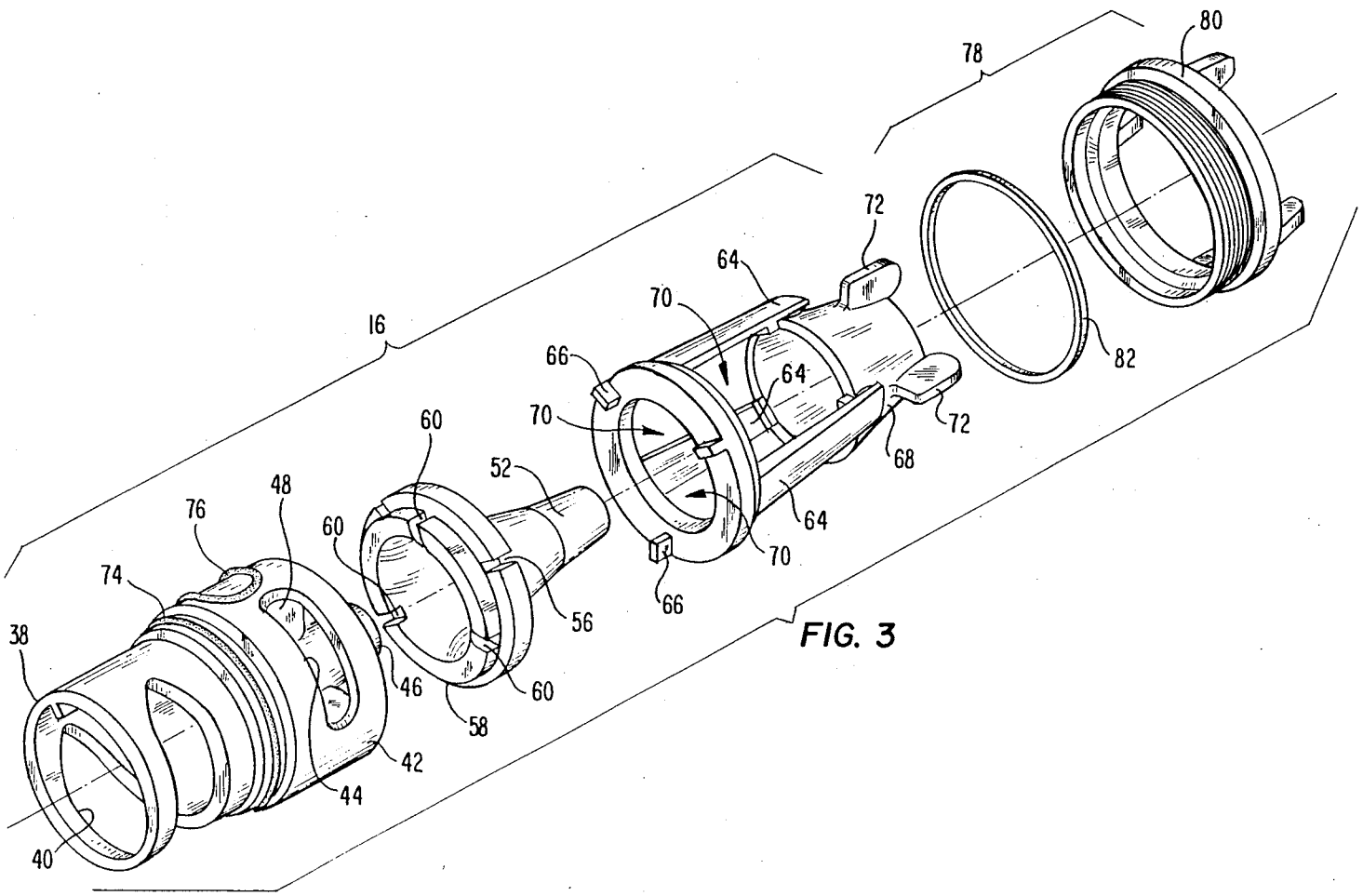
FIG. 3 is an exploded perspective view of an adjustable nozzle assembly and a retaining ring assembly for the hydrotherapeutic jet illustrated in FIG. 1, both assemblies being removably received within the body or housing portion of FIG. 2 as will be evident from the following Figures.
Figure 4:
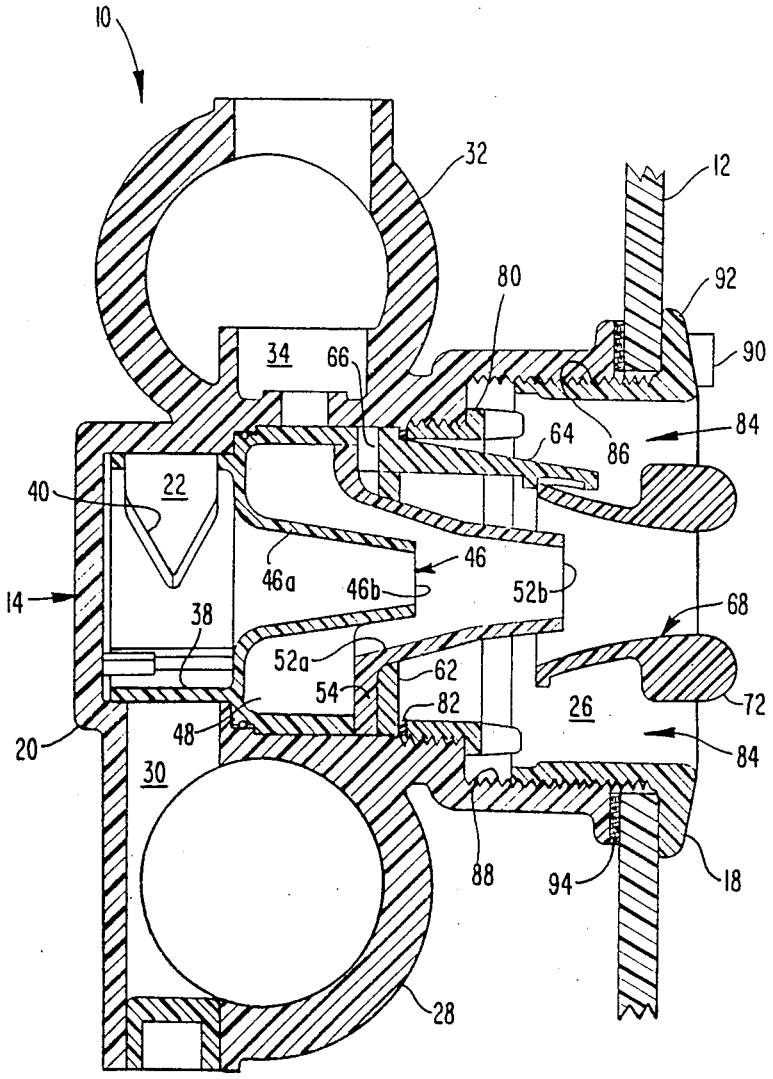
FIG. 4 is a vertical cross-sectional view of the hydrotherapeutic jet illustrated in FIG. 1.

Referring now to FIGS. 2–4, the body 14 includes a housing 20 which contains a rear chamber 22, a centrally-located first mixing chamber 24 and a forwardly-located second mixing chamber 26, the dimensions and positions of which are selected to communicate with the tri-nozzle assembly 16 as will be discussed hereinafter. A water inlet tube 28 adapted for connection to a source of water is located underneath the rear chamber 22 and attached crosswise to the housing 20. Water is supplied to the water inlet tube 28 by a pump (not shown) which typically forms a part of a filtration and circulation system for the water contained in the hydrotherapeutic receptacle. A water inlet port 30 located between the water inlet tube 28 and the housing 20 functions to allow water to flow into the rear chamber 22 from the water inlet tube 28. The body 14 also includes an air supply tube 32 which is located over the first mixing chamber 24 and attached crosswise to the housing 20. The air inlet tube 32 is provided with an air inlet port 34 to allow air to flow into the first mixing chamber 24 from the air inlet tube 32. The body 14 further includes a flange 36 whose function will also be described hereinafter. The housing 20, water inlet tube 28, water inlet port 30, air supply tube 32, air inlet port 34 and flange 36 are formed monolithically by any suitable and conventional process such as injection molding.

The tri-nozzle assembly 16 includes a first sleeve 38 which is journalled for rotation within the rear chamber 22 to function as a water inlet valve. A first cutout 40 extends through the first sleeve 38. When aligned with the water inlet port 30, the first cutout 40 allows water to flow from the water inlet tube 28, through the first sleeve 38 and into the rear chamber 22 as will be discussed hereinafter. A second sleeve 42 journalled for rotation within the first mixing chamber 24 functions as an air inlet valve. A second cutout 44 extends through the second sleeve 42. When aligned with the air inlet port 34, the second cutout 44 allows air to flow from the air supply tube 32, through the second sleeve 42, and into the first mixing chamber 42 as will be discussed hereinafter. A first nozzle 46 provided with a convergent section **46*a* and a throat 46*b* is positioned coaxially within the second sleeve 42. Ribs 48 disposed radially about the first nozzle 46 attach the first nozzle 46 to the second sleeve 42. The ribs 48 perform another function which will be described hereinafter. A first circular base 50 sized and shaped to be received by the second sleeve 42 is attached to the convergent section 46*a* of the first nozzle 46. A central opening in the first circular base 50 is provided to form a path into the convergent section 46*a* of the first nozzle 46. The circular base 50 is connected to the second sleeve 42 in a watertight manner. The first sleeve 38 is connected to the circular base 50 opposite the first nozzle 46. The first and second sleeves 38 and 42, the first nozzle 46, the ribs 48 and the base 50** are formed monolithically. That is, they form a single piece.

A second nozzle 52 is provided with a convergent section 52*a* and a throat 52*b*. A second circular base 54 sized and shaped to be received by the second sleeve 42 is attached to the convergent section 52*a* of the second nozzle 52. A central opening in the second circular base 54 is provided to form a path into the convergent section 52*a*. A set of first slots 56, the function of which will be described hereinafter, is located about the circumference of the second circular base 54. A collar 58 having an outer diameter less than that of the second circular base 54 but having the same sized central opening thereas is attached thereto. A set of second slots 60 is provided on the collar 58, the slots 60 being sized, shaped and positioned to receive the ribs 48. The length of the ribs 48 must be selected such that the throat 46*b* of the first nozzle 46 extends into the convergent section 52*a* of the second nozzle 52.

A mounting ring 62 is provided with a central opening to receive the second nozzle 52. Capturing prongs 64 extend outwardly from one side of the mounting ring 62, and mounting prongs 66 extend from the other side of the mounting ring 62 in a direction away from the capturing prongs 64. The mounting prongs 66 are sized and shaped to be received by the first slots 56 such that the mounting ring 62 is attached conjointly to the second circular base 54. A directional nozzle 68 which communicates with the second nozzle 52 is held by the capturing prongs 64 such that the directional nozzle 68 can be pivoted and rotated in order to direct the flow of the water being discharged therefrom. The directional nozzle 68 may be permanently or removably captured by the capturing prongs 64, which are spaced apart so as to form channels 70 between the mounting ring 62 and the directional nozzle 68. The channels 70 are provided for a purpose which will become evident when the operation of the hydrotherapeutic jet 10 is described hereinafter. Directional tabs 72 are attached to the discharge nozzle 68 to allow for the manual rotation thereof.

The tri-nozzle assembly 16 is inserted into the housing 20 such that the rear chamber 22 receives the first sleeve 38 and such that the first mixing chamber 24 receives the second sleeve 42. Glide rings 74 and 76, such as Teflon bearings, function to center the tri-nozzle assembly 16 within the housing 20 and to reduce the friction created therebetween as a result of their relative movement. The tri-nozzle assembly 16 is removably maintained in the body 14 by a retaining ring assembly 78 (see FIG. 3), which includes a locking ring 80 adapted to threadedly engage the housing 20 and an anti-friction ring 82 interposed between the locking ring 80 and the mounting ring 62. The locking ring 80 retains the second sleeve 42 within the first mixing chamber 24, while the anti-friction ring 82 permits the tri-nozzle assembly 16 to be freely rotated within the housing 20 for a purpose which will be described hereinafter.

The bulkhead fitting 18 is substantially circular in shape and has a central opening sized and shaped to receive the directional nozzle 68 in such a manner that an annular gap 84 is formed between the bulkhead fitting 18 and the directional nozzle 68. The function of the annular gap 84 will be described hereinafter. External threads 86 on the bulkhead fitting 18 cooperate with internal threads 88 located within the second mixing chamber 26 to threadedly connect the body 14 to the bulkhead fitting 18. This threaded connection is facilitated by mounting tabs 90 attached to the exterior surface of the bulkhead fitting 18. The mounting tabs 90 allow for rotation of the bulkhead fitting 18 relative to the body 14 during the installation of the hydrotherapeutic jet 10. If the hydrotherapeutic jet 10 is properly installed, a flange 92 on the bulkhead fitting 18 cooperates with the flange 36 on the body 14 to clamp the hydrotherapeutic jet 10 in place on the sidewall 12 of the hydrotherapeutic receptacle. A gasket 94 is interposed between the flange 36 and the sidewall 12 to inhibit water from leaking from the hydrotherapeutic receptacle. Metallic escutheons (not shown) can be permanently or removably mounted on the bulkhead fitting 18 for decorative purposes.

Figure 5:
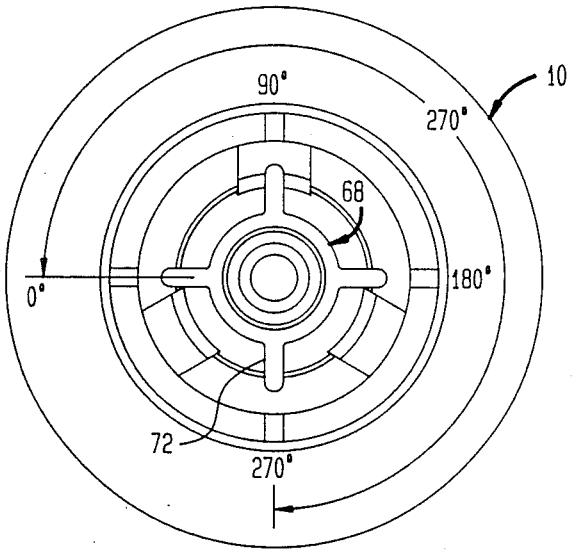
FIG. 5 is a partial front elevational view of the hydrotherapeutic jet fitting illustrated in FIG. 1, various different angular positions of the nozzle assembly being denoted to facilitate consideration and discussion of the following Figures.

Referring now to FIG. 5, the hydrotherapeutic jet 10 can be selected to operate in any one of three modes by rotating the tri-nozzle assembly 16 between zero and two hundred seventy degrees (degree indicia on the bulkhead fitting 18 being shown for reference purposes only). By rotating the directional tabs 72, the discharge nozzle 68, mounting ring 62, second circular base 54, second sleeve 42 and first sleeve 38 are all rotated conjointly, whereby the first and second cutouts 40 and 44 are rotated conjointly (see FIG. 3 for greater clarity). The alignment of the first and second cutouts 40 and 44 with respect to the water and air inlet ports 30 and 34 determines the mode of operation.

Figure 7:
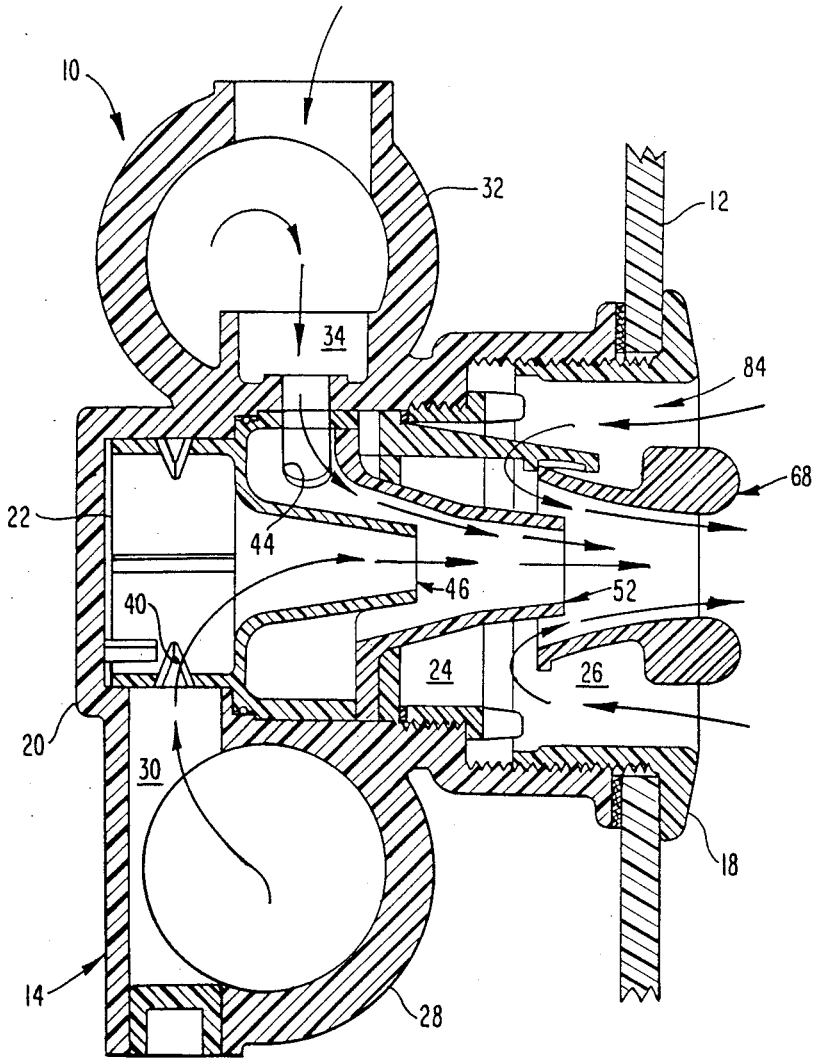
FIG. 7 is a vertical cross-sectional view of the hydrotherapeutic jet illustrated in FIG. 1 during one mode of operation.

Referring now to FIG. 7, the hydrotherapeutic jet is shown operating in the first mode in which a primary stream of water is mixed with air during a first stage, entrained with a secondary stream of water drawn from the receptacle during a second stage, and finally discharged into the hydrotherapeutic receptacle. The tri-nozzle assembly 16 is rotated between zero and ninety degrees such that the first and second cutouts 40 and 44 are aligned with the water and air inlet ports 30 and 34, respectively. The primary stream of water flows from the water inlet tube 28, through the water inlet port 30 and the first cutout 40, and into the rear chamber 22. The primary stream flows from the rear chamber 22 into the first nozzle 46, the shape of which increases the velocity of the water as the water is discharged into the first mixing chamber 24, thereby creating a low pressure condition within the first mixing chamber 24. This low pressure condition, in turn, causes a "jet pump" effect which draws air into the first mixing chamber 24 from the air supply tube 32. As a result, the primary stream is aerated.

From the first mixing chamber 24, the aerated primary stream flows into the second nozzle 52, the shape of which increases the velocity of the water as it is discharged into the second mixing chamber 26. The result is a low pressure condition within the second mixing chamber 26 which causes a "jet pump" effect which, in turn, results in a secondary stream of water being sucked into the second mixing chamber 26 from the hydrotherapeutic receptacle, the secondary stream of water flowing through the annular gap 76 and the channels 70. The resulting water/air stream is then discharged into the hydrotherapeutic receptacle at a high velocity by the discharge nozzle 68. Thus, air is mixed with the primary stream in the first mixing chamber 24 during the first stage, and the aerated primary stream is entrained with a secondary stream in the second mixing chamber 26 during the second stage to create the desired whirlpool action and hydromassage effect.

Figure 6:
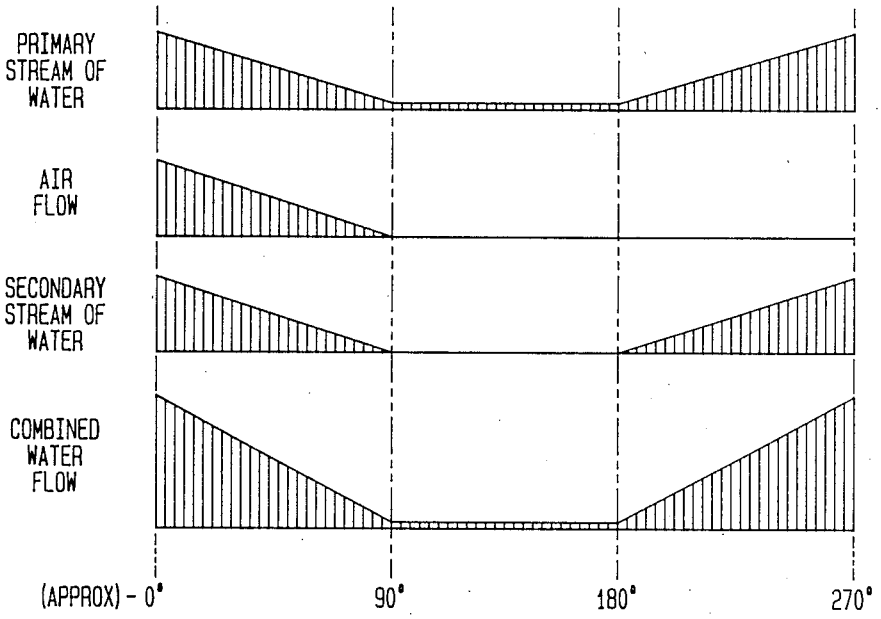
FIG. 6 is a graph correlating the rate of flow for a primary stream of water to flow rates for air, a secondary stream of water and combined streams in relation to the position of the nozzle assembly illustrated in FIG. 5.

Referring to FIG. 6, the rates of aeration and entrainment during the first mode of operation are proportional to the rate that the primary stream flows into the rear chamber 22. As the tri-nozzle assembly 16 is rotated between zero degrees and ninety degrees, an increase or decrease in the flow rate of the primary stream results in a corresponding increase or decrease in flow of the secondary stream into the second mixing chamber 26. Likewise, the rate of air flowing into the first mixing chamber 24 and the rate of the combined streams being discharged into the hydrotherapeutic receptacle are effected. Additionally, the flow of air is regulated by the position of the second cutout 44. These flow rates, of course, are dependent upon the positions of the first and second cutouts 40 and 44 relative to the water and air inlet ports 30 and 34, respectively. The size, shape and position of the first and second cutouts 40 and 44 can be determined by a person skilled in the art. Thus, the various flow rates of the hydrotherapeutic jet 10 are regulated by adjusting the flow rate of the primary stream of water.

The hydrotherapeutic jet 10 illustrated in FIG. 4 is shown in the second mode of operation. The tri-nozzle assembly 16 is rotated between ninety and one hundred eighty degrees. The first cutout 40 allows the primary stream to trickle into the rear chamber 22. This "pressure relief" feature prevents pressure from building up in the water inlet tube 28 and damaging the first sleeve 38. Due to the low flow rate of the primary stream, air is not sucked into the first mixing chamber 24, the secondary stream is not sucked into the second mixing chamber 26, and the combined water flow from the discharge nozzle 68 is a mere trickle (see FIG. 6). Thus, the second mode represents the "off" position for the hydrotherapeutic jet 10.

Figure 8:
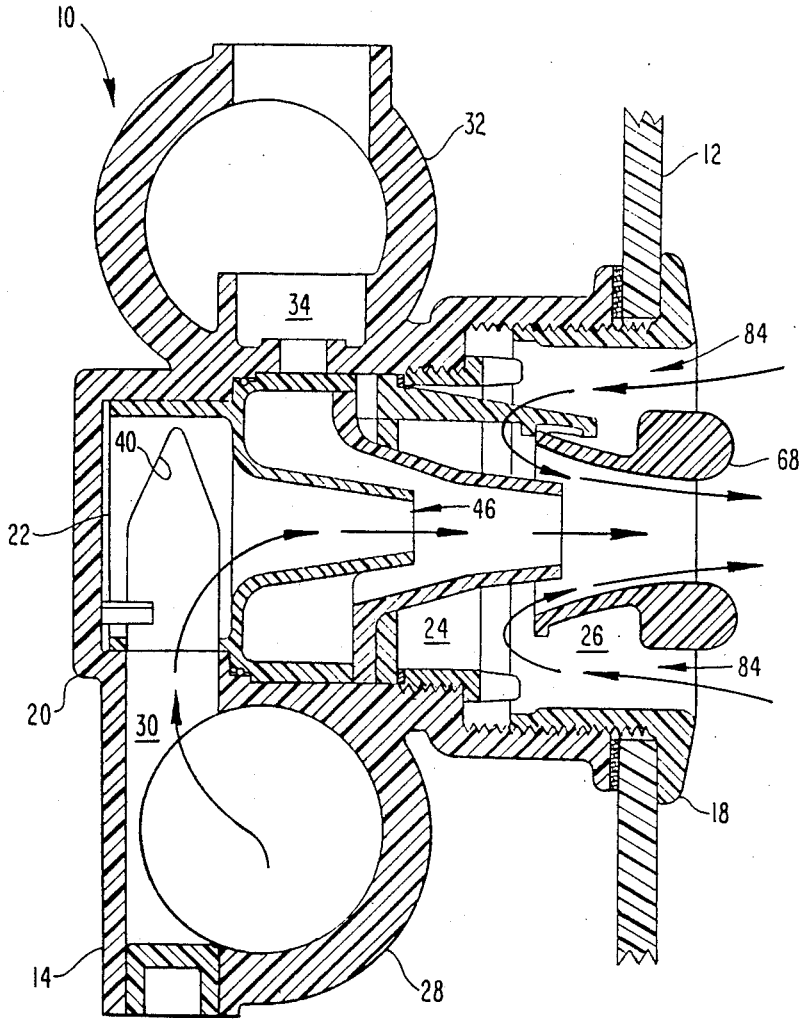
FIG. 8 is a vertical cross-sectional view of the hydrotherapeutic jet illustrated in FIG. 1 during another mode of operation.

Referring now to FIG. 8, the hydrotherapeutic jet 10 is shown operating in the third mode whereby the secondary stream, and that stream only, is entrained with the primary stream of water. The tri-nozzle assembly 16 is rotated between one hundred and eighty degrees and two hundred and seventy degrees such that only the first cutout 40 aligns with the water inlet port 30. The primary stream flows through the first and second nozzles 46 and 52, is entrained with the secondary stream in the second mixing chamber 24, and is discharged into the receptacle in the same manner described in the first mode of operation. Thus, only the second stage is operative. The flow rates for the primary stream, secondary stream and combined flow are the same as in the first mode of operation; however, since the air inlet port 34 is closed, the flow of air is blocked (see FIG. 6). Thus, in the third mode of operation, the hydrotherapeutic jet 10 discharges an entrained, non-aerated stream into the hydrotherapeutic receptacle.

By aerating the primary stream of water in the first mixing chamber 24 during a first stage, and entraining the primary and secondary streams in the second mixing chamber 26 during a separate second stage, both aeration and entrainment are performed efficiently. The flow rates of air, the secondary stream and the combined streams are regulated by rotating the first sleeve 38 which adjusts the flow of the primary stream of water into the hydrotherapeutic jet 10. Such regulation of the primary stream eliminates the need for a valve to regulate the flow of the secondary stream of water through the bulkhead fitting 18 and into the second mixing chamber 26. Accordingly, the hydrotherapeutic jet 10 can achieve comparatively high flow rates, which result in improved circulation of the water contained in the hydrotherapeutic receptacle, as well as enhanced whirlpool motion and hydromassage effect.

It will be understood that the embodiment described herein is merely exemplary and that a person skilled in the art may make many variations and modifications without departing from the spirit and scope of the invention. All such variations and modifications are intended to be included within the scope of the invention as defined in the appended claims.

We claim:

1. In a hydrotherapeutic jet adapted to be mounted to the wall of a hydrotherapeutic receptacle, including an entrainment chamber located internally of said jet, first inlet means for providing communication between the entrainment chamber and a source of pressurized water, second inlet means for providing communication between the entrainment chamber and the hydrotherapeutic receptacle, the first inlet means including accelerating means for increasing the velocity of water being discharged into the entrainment chamber from the first inlet means to thereby create a low pressure condition within the entrainment chamber, the low pressure condition being sufficient to suck water into the entrainment chamber through the second inlet means, and discharging means for discharging water contained in the entrainment chamber into the receptacle, the improvement comprising an aeration chamber located internally of said jet and communicating between the source of pressurized water and the accelerating means; air supply means for providing a supply of air to said aeration chamber, whereby pressurized water can be mixed with an air within said aeration chamber and the resulting air/water mixture can then be supplied from the aeration chamber to the entrainment chamber through the accelerating means; and another accelerating means for increasing the velocity of water discharged into said aeration chamber, thereby creating a low pressure condition within said aeration chamber which sucks air supplied by said air supply means into said aeration chamber.

2. A hydrotherapeutic jet according to claim 1, wherein the entrainment chamber and said another accelerating means are positioned on opposite sides of said aeration chamber.

3. A hydrotherapeutic jet according to claim 2, wherein said another accelerating means is a nozzle having a convergent section and a throat, pressurized water being supplied to said convergent section and being discharged from said throat into said aeration chamber.

4. A hydrotherapeutic jet according to claim 3, wherein said throat of said nozzle is located entirely within said aeration chamber and said convergent section is located substantially outside said aeration chamber.

5. A hydrotherapeutic jet according to claim 3, wherein the first inlet means further includes first regulating means for regulating the supply of pressurized water into said convergent section of said nozzle.

6. A hydrotherapeutic jet according to claim 5, wherein pressurized water is supplied to said convergent section of said nozzle by a water inlet tube, and wherein said first regulating means is a first sleeve journalled for rotation within said jet and including a first cutout located so as to allow pressurized water to flow into said convergent section of said nozzle, whereby the flow of pressurized water can be regulated by rotating said first sleeve to thereby align said first cutout with said water inlet tube.

7. A hydrotherapeutic jet according to claim 6, wherein said air supply means includes an air inlet tube adapted to supply air to said aeration chamber from the top thereof.

8. A hydrotherapeutic jet according to claim 7, wherein said air supply means further includes second regulating means for regulating the supply of air to said aeration chamber.

9. A hydrotherapeutic jet according to claim 8, wherein said second regulating means is a second sleeve journalled for rotation within said jet and including a second cutout located so as to allow air to flow into said aeration chamber, whereby the flow of air can be regulated by rotating said second sleeve to thereby align said second cutout with said air inlet tube.

10. A hydrotherapeutic jet according to claim 9, wherein said first and second sleeves are rotated conjointly, whereby said first and second cutouts are rotated conjointly, and wherein said first and second cutouts are shaped, sized and positioned so as to define modes of operation according to their alignments with said water and air inlet tubes, respectively.

11. A hydrotherapeutic jet according to claim 10, wherein a mode of operation is defined by aligning said first and second cutouts with said water and air inlet tubes, respectively, such that pressurized water is mixed with air in said aeration chamber, whereby an air/water mixture discharged from said aeration chamber can be mixed with water sucked in from the hydrotherapeutic receptacle in said entrainment chamber and the resulting air/water mixture can then be discharged from said entrainment chamber into the hydrotherapeutic receptacle.

12. A hydrotherapeutic jet according to claim 10, wherein a mode of operation is defined by aligning said first cutout with said water inlet tube such that pressurized water flowing into said aeration chamber is not mixed with air, whereby water within said aeration chamber can be discharged into the entrainment chamber and mixed therein with water sucked in from the hydrotherapeutic receptacle and a resulting water/water mixture within the entrainment chamber can then be discharged into the hydrotherapeutic receptacle.

13. A hydrotherapeutic jet according to claim 10, wherein a mode of operation is defined by aligning said first cutout with said water inlet tube such that pressurized water trickles into said aeration chamber, whereby water in said aeration chamber is not mixed with air and only a relatively small amount of water can flow from said aeration chamber into said entrainment chamber.

14. A hydrotherapeutic jet adapted to be mounted on a wall of a hydrotherapeutic receptacle, comprising a first mixing chamber located centrally within said jet; air inlet means for providing a supply of air to said first mixing chamber; first inlet means for providing communication between said first mixing chamber and a source of pressurized water, said first inlet means including first accelerating means for increasing the velocity of water being discharged into said first mixing chamber from said first inlet means and thereby creating a low pressure condition within said first mixing chamber which is sufficient to suck air into said first mixing chamber through said air inlet means, whereby said first mixing chamber also functions as a suction chamber; a second mixing chamber located within said jet between said first mixing chamber and the wall of the hydrotherapeutic receptacle; second inlet means for providing communication between said second mixing chamber and the hydrotherapeutic receptacle; second accelerating means for increasing the velocity of water being discharged into said second mixing chamber from said first mixing chamber to thereby create a low pressure condition within said second mixing chamber which is sufficient to suck water into said second mixing chamber from the hydrotherapeutic receptacle through said second inlet means, whereby said second mixing chamber also functions as a suction chamber; and discharging means for discharging a mixture of water and, air into the hydrotherapeutic receptacle from said second mixing chamber.

15. A hydrotherapeutic jet according to claim 14, wherein said second mixing chamber and said first accelerating means are positioned on opposite sides of said first mixing chamber.

16. A hydrotherapeutic jet according to claim 15, wherein said first accelerating means is a first nozzle having a convergent section and a throat, water discharged from said first nozzle being supplied to said second nozzle and being discharged from said second nozzle into said second mixing chamber.

17. A hydrotherapeutic jet according to claim 16, wherein said first inlet means further includes a water inlet tube for supplying the pressurized water to said convergent section of said first nozzle.

18. A hydrotherapeutic jet according to claim 17, wherein said first inlet means further includes first regulating means for regulating the supply of pressurized water flowing from said water inlet tube to said convergent section of said first nozzle.

19. A hydrotherapeutic jet according to claim 18, wherein said first regulating means is a first sleeve journalled for rotation within said jet and including a first cutout located so as to allow pressurized water to flow into said convergent section of said first nozzle, whereby the flow of pressurized water can be regulated by rotating said first sleeve to thereby align said first cutout with said water inlet tube.

20. A hydrotherapeutic jet according to claim 19, wherein said first air inlet means includes an air inlet tube. adapted to supply air to said first mixing chamber from the top thereof.

21. A hydrotherapeutic jet according to claim 20, wherein air inlet means further includes second regulating means for regulating the supply of air to said first mixing chamber.

22. A hydrotherapeutic jet according to claim 21, wherein said second regulating means is a second sleeve journalled for rotation within said jet and including a second cutout located so as to allow air to flow into said first mixing chamber, whereby the flow of air can be regulated by rotating said second sleeve to thereby align said second cutout with said air inlet tube.

23. A hydrotherapeutic jet according to claim 22, wherein said first and second sleeves are rotated conjointly, whereby said first and second cutouts are rotated conjointly, and wherein said first and second cutouts are shaped, sized and positioned to define modes of operation according to alignments with said water and air inlet tubes, respectively.

24. A hydrotherapeutic jet according to claim 23, wherein a mode of operation is defined by aligning said first and second cutouts with said water and air inlet tubes, respectively, such that pressurized water is mixed with air in said first mixing chamber, whereby an air/-water mixture within said first mixing chamber can be discharged into said second mixing chamber and mixed therein with water sucked in from the hydrotherapeutic receptacle and the resulting air/water mixture can then be discharged from said second mixing chamber into the hydrotherapeutic receptacle.

25. A hydrotherapeutic jet according to claim 23, wherein a mode of operation is defined by aligning said first cutout with said water inlet tube such that pressurized water flowing into said first mixing chamber is not mixed with air, whereby water within said first mixing chamber can be discharged into said second mixing chamber and mixed therein with water sucked in from the hydrotherapeutic receptacle and the resulting air/-water mixture can then be discharged from said second mixing chamber into the hydrotherapeutic receptacle.

26. A hydrotherapeutic jet according to claim 23, wherein a mode of operation is defined by aligning said first cutout with said water inlet tube such that the pressurized water trickles into said first mixing chamber, whereby water in said first mixing chamber is not mixed with air and only a relatively small amount of water can flow from said first mixing chamber into said second mixing chamber.

27. A hydrotherapeutic jet according to claim 22, wherein said second accelerating means is a second nozzle having a convergent section and a throat, water discharged from said first nozzle being supplied to said convergent section of said second nozzle and being discharged from said throat of said second nozzle into said second mixing chamber.

28. A hydrotherapeutic jet according to claim 27, wherein said convergent section of said second nozzle is located substantially within said first mixing chamber opposite said first nozzle and said throat of said second nozzle is located within said second chamber.

29. A hydrotherapeutic jet according to claim 28, wherein said convergent section of said second nozzle is in close proximity to said throat of said first nozzle.

30. A hydrotherapeutic jet according to claim 14, wherein said second accelerating means and said discharging means are positioned on opposite sides of said second mixing chamber.

31. A hydrotherapeutic jet according to claim 30, wherein said discharging means includes a third nozzle.

32. A hydrotherapeutic jet according to claim 31, wherein said second inlet means is located proximate to said third nozzle, whereby water sucked into said second mixing chamber through said second inlet means flows adjacent to said third nozzle.

33. A hydrotherapeutic jet according to claim 32, wherein said second inlet means substantially surrounds said third nozzle.

34. A hydrotherapeutic jet according to claim 32, wherein said second inlet means defines a flow path which runs from the hydrotherapeutic receptacle directly to said second mixing chamber.

35. A hydrotherapeutic jet according to claim 34, wherein water is discharged from said discharging means in a first direction and wherein water sucked into said second mixing chamber through said second inlet means flows in a second direction which is generally opposite to said first direction.

36. A hydrotherapeutic jet according to claim 35, wherein said flow path is completely contained within said jet.

37. A method of creating a whirlpool motion in a hydrotherapeutic receptacle using a hydrotherapeutic jet adapted to be mounted on a wall of the hydrotherapeutic receptacle, the hydrotherapeutic jet including a first mixing chamber located centrally within said jet, air inlet means for providing a supply of air to said first mixing chamber, first inlet means for providing communication between said first mixing chamber and a source of pressurized water, said first inlet means including first accelerating means for increasing the velocity of water being discharged into said first mixing chamber from said first inlet means and thereby creating a low pressure condition within said first mixing chamber which is sufficient to suck air into said first mixing chamber through said air inlet means, whereby said first mixing chamber also functions as a suction chamber, a second mixing chamber located within said jet between said first mixing chamber and the wall of the hydrotherapeutic receptacle, second inlet means for providing communication between said second mixing chamber and the hydrotherapeutic receptacle, second accelerating means for increasing the velocity of water being discharged into said second mixing chamber from said first mixing chamber to thereby create a low pressure condition within said second mixing chamber which is sufficient to suck water into said second mixing chamber from the hydrotherapeutic receptacle through said second inlet means, whereby said second mixing chamber also functions as a suction chamber, and discharging means for discharging a mixture of water and air into the hydrotherapeutic receptacle from said mixing chamber, said method comprising the steps of:

(a) supplying pressurized water to the first accelerating means;

(b) utilizing the first accelerating means to increase the velocity of the pressurized water as said water is discharged into the first mixing chamber and to thereby create a low pressure condition within the first mixing chamber;

(c) supplying air to the first mixing chamber, whereby said air is mixed with the water present in the first mixing chamber;

(d) supplying water from the first mixing chamber to the second mixing chamber;

(e) utilizing the second accelerating means to increase the velocity of the water flowing from the first mixing chamber to the second mixing chamber and to thereby create a low pressure condition within the second mixing chamber;

(f) supplying water from the hydrotherapeutic receptacle to the second mixing chamber, whereby water from the receptacle is mixed with the water flowing from the first mixing chamber; and (g) discharging the air/water mixture from the second mixing chamber into the hydrotherapeutic receptacle through the discharging means.

38. A method according to claim 37, wherein the hydrotherapeutic jet further includes first regulating means for regulating the flow of said pressurized water to the first accelerating means, said method further comprising the step of regulating the flow of said pressurized water which is flowing to the first accelerating means.

39. A method according to claim 38, wherein the hydrotherapeutic jet further includes second regulating means for regulating the flow of air to the first mixing chamber, said method further comprising the step of regulating the flow of the air which is flowing to the first accelerating means, said flow of air and said flow of pressurized water being regulated simultaneously.

* * * * *